US011330961B1

(12) United States Patent
Rowe et al.

(10) Patent No.: US 11,330,961 B1
(45) Date of Patent: May 17, 2022

(54) DISHWASHER APPLIANCE WITH STEMWARE HOLDER ASSEMBLY

(71) Applicant: Haier US Appliance Solutions, Inc., Wilmington, DE (US)

(72) Inventors: Jason Allen Rowe, Louisville, KY (US); Tai Abraham Ohayon, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/113,875

(22) Filed: Dec. 7, 2020

(51) Int. Cl.
*A47L 15/50* (2006.01)

(52) U.S. Cl.
CPC ..... *A47L 15/505* (2013.01); *A47L 15/503* (2013.01)

(58) Field of Classification Search
CPC ..... A47L 15/50; A47L 15/503; A47L 15/505
USPC ..... 211/41.1–41.9
See application file for complete search history.

(56) References Cited

U.S. PATENT DOCUMENTS 2,655,267 A * 10/1953 Planeta ..... A47L 19/04 211/74
2,708,037 A * 5/1955 Planeta ..... A47L 19/04 211/74
3,612,285 A * 10/1971 Mason ..... A47L 15/503 211/41.8
4,589,556 A * 5/1986 Peretz ..... A47L 15/505 211/41.2
4,726,475 A * 2/1988 Ferenzi ..... A47L 19/04 211/41.5
6,394,285 B1 * 5/2002 Arthurs ..... A47L 15/505 211/41.9
7,458,471 B2 * 12/2008 Crudgington, Jr. ... A47L 15/505 211/41.9
8,042,559 B2 * 10/2011 Choi ..... B08B 3/04 134/137
9,877,632 B2 * 1/2018 Roberson ..... A47L 15/505
10,052,012 B2 8/2018 Mesa et al.
10,159,397 B2 12/2018 Citak et al.
10,368,718 B2 8/2019 Wilson et al.
10,405,731 B2 9/2019 Harr
10,463,226 B2 11/2019 Mesa et al.
10,945,585 B2 * 3/2021 Mohite ..... A47L 15/505
(Continued)

FOREIGN PATENT DOCUMENTS

CN 108095655 A 6/2018
CN 110101347 A 8/2019
(Continued)

*Primary Examiner* — Patrick D Hawn
(74) *Attorney, Agent, or Firm* — Dority & Manning, P.A.

(57) ABSTRACT

A dishwasher appliance includes a tub that defines a wash chamber, a door that permits selective access to the wash chamber, a rack assembly within the wash chamber and receiving articles for cleaning, and a stemware holder assembly. The rack assembly includes an upper rack and a lower rack. The stemware holder assembly has at least one arm member secured to a side wall of the lower rack. The arm member(s) is movable between an engaged position and a disengaged position. Further, the arm member(s) includes at least one arm having a hook at a distal end thereof for receiving a stem of a stemware. As such, when the stemware holder assembly is in the engaged position, the hook orients the stem of the stemware in a direction away from the side wall of the lower rack.

20 Claims, 6 Drawing Sheets

(56) References Cited

U.S. PATENT DOCUMENTS

| | | | | |
|---|---|---|---|---|
| 11,006,814 | B1 * | 5/2021 | Simmonds | A47L 15/505 |
| 2005/0242046 | A1 * | 11/2005 | Lee | A47L 15/503 211/41.9 |
| 2006/0138064 | A1 * | 6/2006 | Crudgington | A47L 15/505 211/41.9 |
| 2007/0039904 | A1 * | 2/2007 | Purushothaman | A47L 15/504 211/41.8 |
| 2007/0131696 | A1 * | 6/2007 | Schessl | A47L 15/505 220/489 |
| 2009/0120883 | A1 * | 5/2009 | Jadhav | A47L 15/505 211/41.9 |
| 2011/0192808 | A1 * | 8/2011 | Buhl | A47L 15/505 211/41.9 |
| 2011/0253650 | A1 * | 10/2011 | Renz | A47L 15/503 211/41.9 |
| 2014/0021149 | A1 * | 1/2014 | Eng | A47L 15/505 211/41.8 |
| 2016/0037997 | A1 * | 2/2016 | Mesa | A47L 15/505 134/166 R |
| 2019/0290098 | A1 * | 9/2019 | Mohite | A47L 15/505 |
| 2020/0281441 | A1 * | 9/2020 | Kim | A47L 15/503 |
| 2020/0329947 | A1 * | 10/2020 | Clerkin | A47L 15/50 |

FOREIGN PATENT DOCUMENTS

| | | | | |
|---|---|---|---|---|
| CN | 105534462 | B | 12/2019 | |
| CN | 110881920 | A | 3/2020 | |
| DE | 10106763 | A1 | 8/2002 | |
| DE | 102014226808 | A1 * | 6/2016 | A47L 15/503 |
| EP | 1929928 | B1 | 2/2012 | |
| EP | 2815690 | A1 * | 12/2014 | A47L 15/505 |
| EP | 2798996 | B1 | 8/2015 | |
| EP | 3164045 | B1 | 8/2018 | |
| GB | 1393054 | A | 5/1975 | |
| WO | WO2013/045543 | A1 | 4/2013 | |

* cited by examiner

DISHWASHER APPLIANCE WITH STEMWARE HOLDER ASSEMBLY

FIELD OF THE INVENTION

The present subject matter relates generally to dishwasher appliances and, in particular, to a dishwasher appliance having a rack assembly with an improved stemware holder assembly.

BACKGROUND OF THE INVENTION

Dishwasher appliances generally include a tub that defines a wash chamber. Dishwasher appliances also generally include a rack assembly mounted within the wash chamber. The rack assembly is configured for receipt of articles for washing. For example, a user can slide the rack assembly out of the wash chamber and load plates, bowls, cups, or any suitable article or combination of articles into the rack assembly. After loading is complete, the user may slide the rack assembly back into the wash chamber.

In particular, the user can slide the rack assembly is to a retracted position. During operation of the dishwasher appliance, such a configuration for the rack assembly is preferable and may be required for certain dishwasher appliance components to function properly. Further, certain dishwasher appliances include a spray assembly mounted to the rack assembly. The spray assembly is normally configured such that the rack assembly must be positioned in the retracted position for the spray assembly to receive wash fluid during operation of the dishwasher appliance. The rack assembly may include, for example, top and bottom racks or top, middle, and bottom racks.

In certain dishwasher appliances, the top rack assembly may include a stemware holder on either side thereof. However, the top rack places stringent height restrictions on stemware placed therein. Furthermore, with the addition of a middle rack, such height restrictions are even more stringent.

Accordingly, a dishwasher appliance having a rack assembly with an improved stemware holder assembly that addresses the aforementioned issues would be useful. Thus, the present disclosure is directed to a stemware holder assembly for use in the lower rack that can be placed atop the silverware cleaning system such that taller stemware can be placed therein and which also has better wash performance.

BRIEF DESCRIPTION OF THE INVENTION

Aspects and advantages of the invention will be set forth in part in the following description, or may be obvious from the description, or may be learned through practice of the invention.

In an aspect, the present disclosure is directed to a dishwasher appliance having a tub that defines a wash chamber. The dishwasher appliance also includes a door mounted proximate the tub and permits selective access to the wash chamber of the tub. Further, the dishwasher appliance includes a rack assembly mounted within the wash chamber and configured for receipt of articles for cleaning. The rack assembly includes an upper rack and a lower rack. Moreover, the dishwasher appliance includes a stemware holder assembly having at least one arm member secured to a side wall of the lower rack. The arm member(s) is movable between an engaged position and a disengaged position. Further, the arm member(s) includes at least one arm having a hook at a distal end thereof for receiving a stem of a stemware. As such, when the stemware holder assembly is in the engaged position, the hook orients the stem of the stemware in a direction away from the side wall of the lower rack.

In another aspect, the present disclosure is directed to a rack assembly for receipt of articles for cleaning in a dishwasher appliance. The rack assembly includes at least one rack having a side wall and a stemware holder assembly. The stemware holder assembly has at least one arm member secured to the side wall of the at least one rack. The arm member(s) is movable between an engaged position and a disengaged position. Further, the arm member(s) includes at least one arm having a hook at a distal end thereof for receiving a stem of a stemware. As such, when the stemware holder assembly is in the engaged position, the hook orients the stem of the stemware in a direction away from the side wall of the lower rack.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
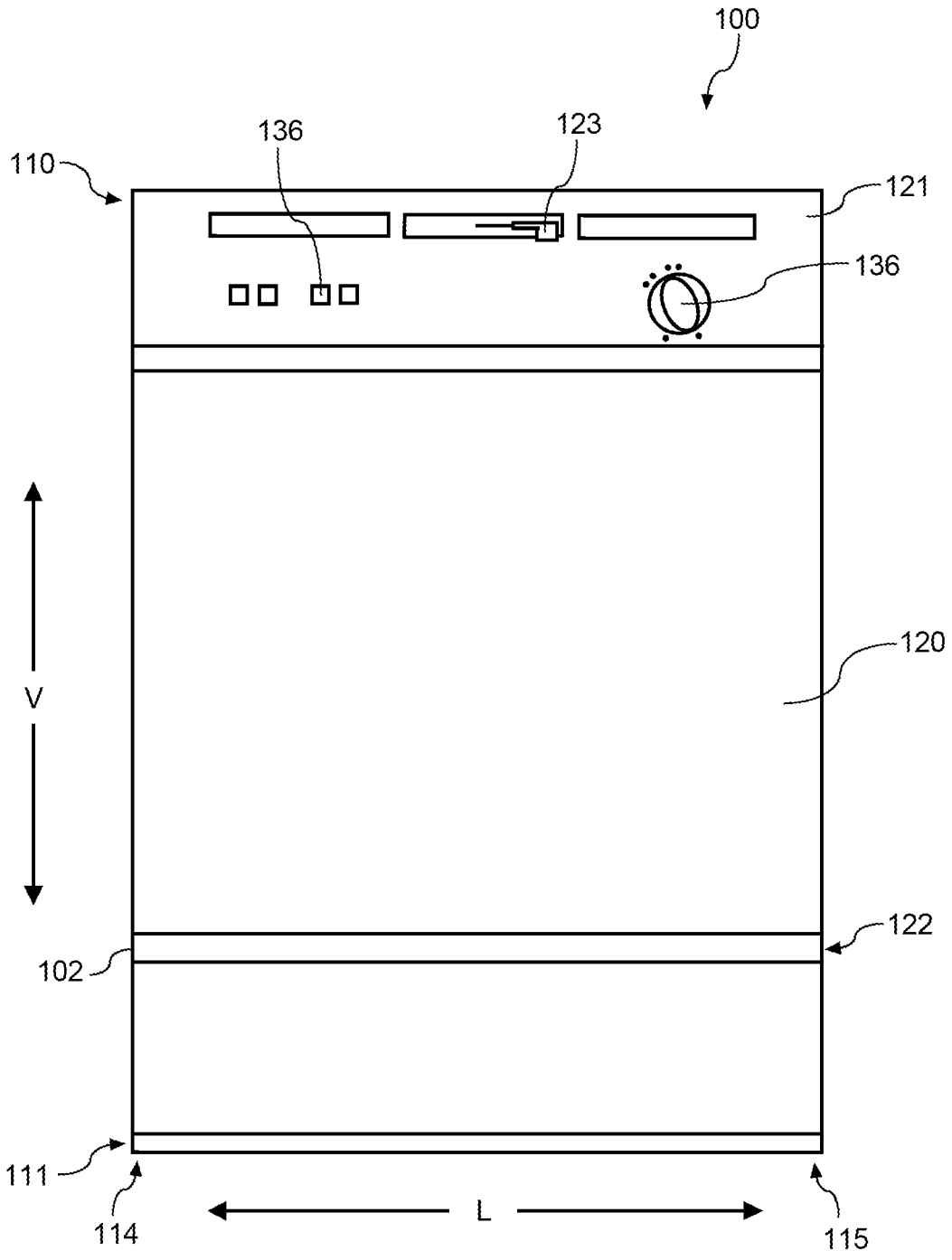
FIG. 1 provides a front view of a dishwasher appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
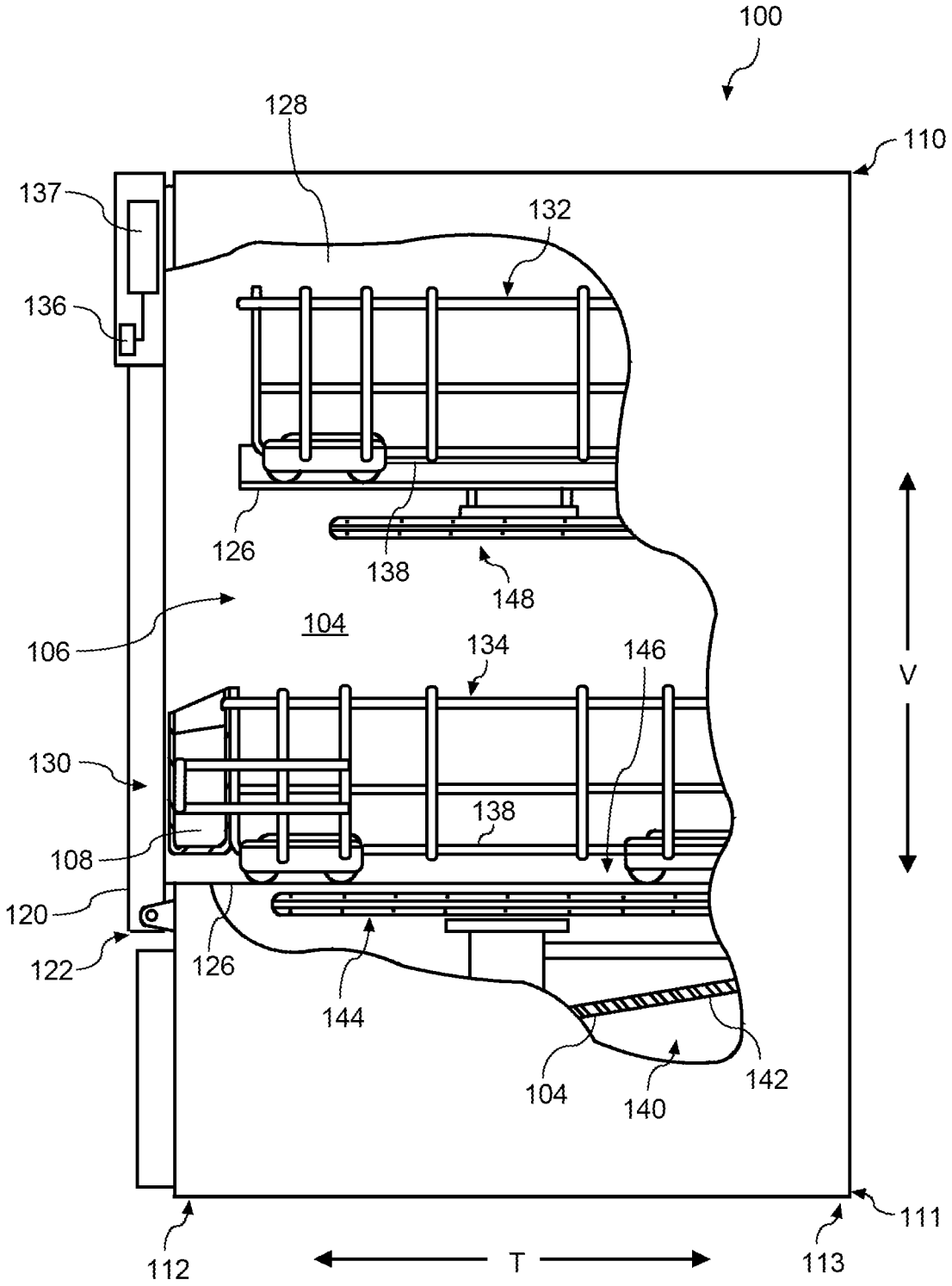
FIG. 2 provides a side view of the dishwasher appliance of FIG. 1 with portions of a cabinet of the dishwasher appliance removed to reveal an interior of the dishwasher appliance.

Referring now to the drawings, FIGS. 1 and 2 depict an exemplary dishwasher appliance 100 that may be configured in accordance with aspects of the present disclosure. The dishwasher appliance 100 includes a cabinet 102 having a tub 104 (FIG. 2) therein that defines a wash chamber 106 (FIG. 2). The tub 104 includes a door 120 hinged at its bottom 122 for movement between a normally closed configuration that is shown in FIGS. 1 and 2, wherein the wash chamber 106 is sealed shut, e.g., during dishwasher appliance 100 operation, and an open configuration, e.g., for loading and unloading of articles from the dishwasher appliance 100. A latch 123 (FIG. 1) is used to lock and unlock the door 120 for access to wash chamber 106.

Dishwasher appliance 100 defines a vertical direction V, a lateral direction L, and a transverse direction T. As may be seen in FIG. 1, dishwasher appliance 100 extends between a top 110 and a bottom 111 along the vertical direction V and also extend between a first side 114 and a second side 115 along the lateral direction L. As may be seen in FIG. 2, dishwasher appliance 100 also extends between a front 112 and a back 113 along the transverse direction T. Vertical direction V, lateral direction L, and transverse direction T are mutually perpendicular and form an orthogonal directional system.

As shown in FIG. 2, guide rails 126 are mounted on tub sidewalls 128 and accommodate a rack assembly 130, e.g. having upper and lower roller-equipped racks 132, 134. Each of the upper and lower racks 132, 134 is fabricated from lattice structures that include a plurality of elongated members 138. Each rack 132, 134 is adapted for movement between an extended loading position (not shown) in which the rack is substantially positioned outside the wash chamber 106, and a retracted position (shown in FIGS. 1 and 2) in which the rack is located inside the wash chamber 106.

A silverware basket 108 is removably mounted to the lower rack 134. However, the silverware basket 108 may also be selectively attached to other portions of dishwasher appliance 100, e.g., the upper rack 132 or the door 120. As such, the silverware basket 108 is configured for receipt of silverware, utensils, and the like (e.g., spoons, forks, and/or knives) that are too small to be accommodated by the upper and lower racks 132, 134. Further, the silverware basket 108 may be constructed of any suitable material, e.g., metal or plastic, and is discussed in greater detail below.

The dishwasher appliance 100 further includes a lower spray assembly 144 that is mounted within a lower region 146 of the wash chamber 106 and above a tub sump portion 142 so as to be positioned in relatively close proximity to lower rack 134. A mid-level spray assembly 148 is located in an upper region of the wash chamber 106 and may be located in close proximity to upper rack 132. In particular, mid-level spray assembly 148 may be mounted to upper rack 132 as discussed in greater detail below.

The spray assemblies 144, 148 are fed by a fluid circulation assembly (not shown) for circulating water and wash fluid in the tub 104. Portions of the fluid circulation assembly may be located in a machinery compartment 140 located below the bottom sump portion 142 of the tub 104, as generally recognized in the art. Each spray assembly includes an arrangement of discharge ports or orifices for directing washing liquid onto dishes or other articles located in the rack assembly 130 and the silverware basket 108. The arrangement of the discharge ports in at least the lower spray assembly 144 provides a rotational force by virtue of washing fluid flowing through the discharge ports. The resultant rotation of the lower spray assembly 144 provides coverage of dishes and other dishwasher contents with a washing spray.

The dishwasher appliance 100 is further equipped with a controller 137 to regulate operation of the dishwasher appliance 100. The controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 137 may be positioned in a variety of locations throughout dishwasher appliance 100. In the illustrated exemplary embodiment, the controller 137 may be located within a control panel area 121 of door 120 as shown. In such an embodiment, input/output ("I/O") signals may be routed between the control system and various operational components of dishwasher appliance 100 along wiring harnesses that may be routed through the bottom 122 of door 120. Typically, the controller 137 includes a user interface panel 136 through which a user may select various operational features and modes and monitor progress of the dishwasher appliance 100. In one exemplary embodiment, the user interface panel 136 may represent a general purpose I/O ("GPIO") device or functional block. In one exemplary embodiment, the user interface panel 136 may include input components, such as one or more of a variety of electrical, mechanical or electro-mechanical input devices including rotary dials, push buttons, and touch pads. The user interface panel 136 may include a display component, such as a digital or analog display device designed to provide operational feedback to a user. The user interface 136 may be in communication with the controller 137 via one or more signal lines or shared communication busses.

It should be appreciated that the present subject matter is not limited to any particular style, model, or other configuration of dishwasher appliance and that the exemplary embodiment depicted in FIGS. 1 and 2 is for illustrative purposes only. For example, the present subject matter may be used in dishwasher appliances having other rack configurations.

Figure 3:
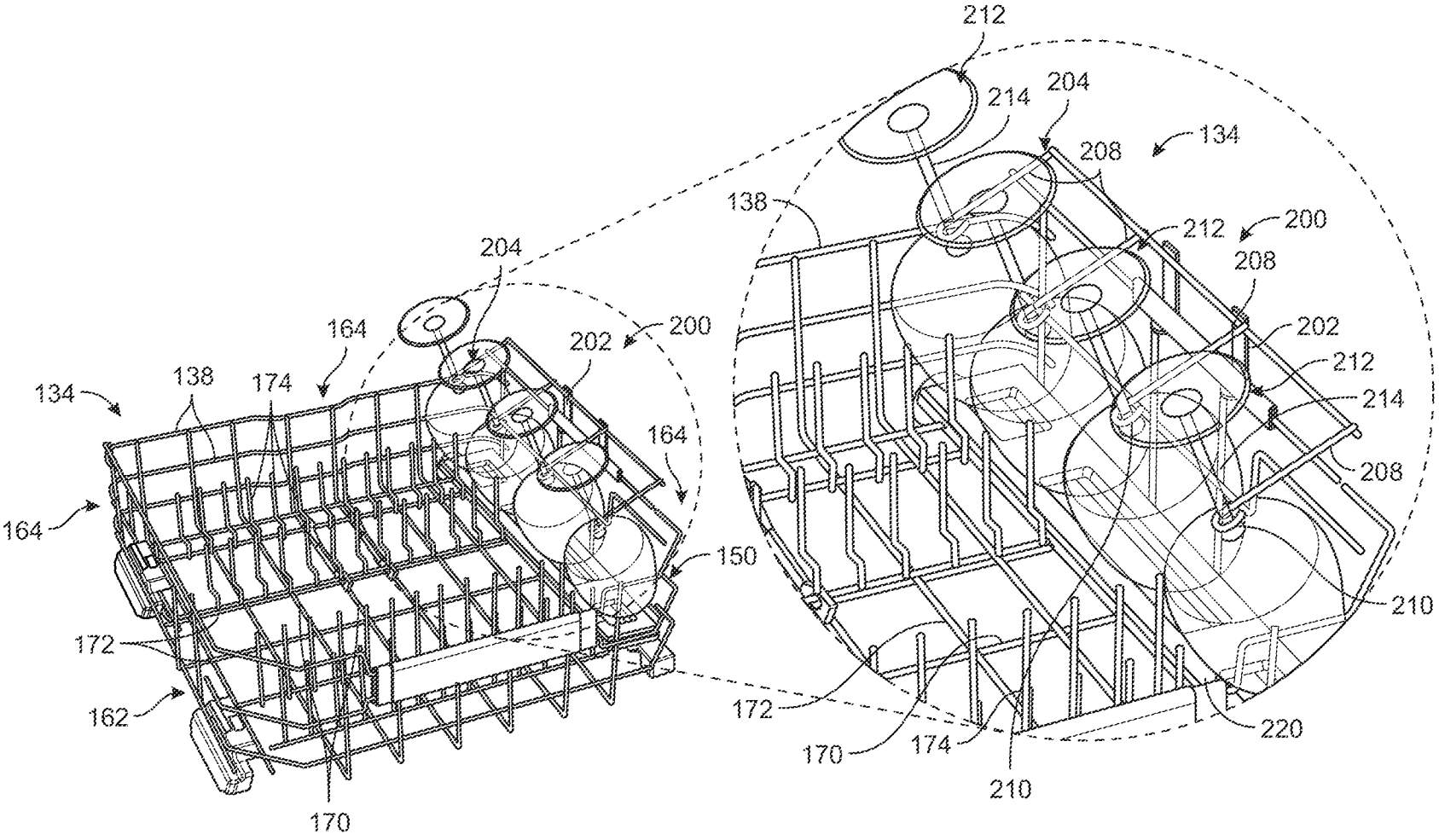
FIG. 3 illustrates a perspective view of a rack assembly and a stemware holder assembly according to an exemplary embodiment of the present subject matter.
Figure 4:
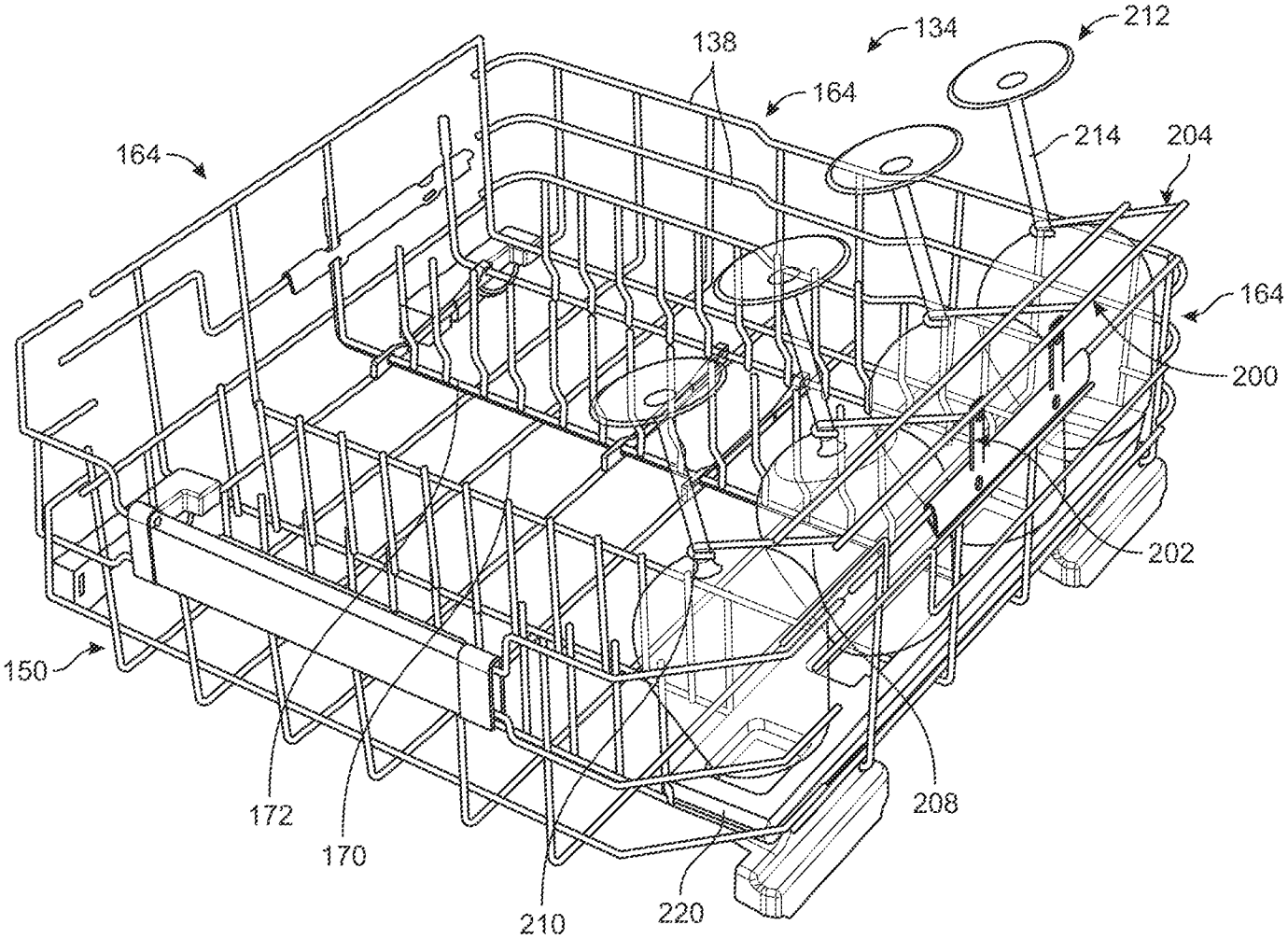
FIG. 4 illustrates another perspective view of a rack assembly and a stemware holder assembly according to an exemplary embodiment of the present subject matter.

Referring now to FIGS. 3 and 4, perspective views of the lower rack 134 with the silverware basket 108 removed from dishwasher appliance 100 is illustrated. As shown, the lower rack 134 is generally configured as a basket-like structure having a bottom wall 162 and a front wall 150 and sidewalls 164 that extends upwardly from the bottom wall 162 along the vertical direction V. Front wall 150 extends along the lateral direction L in order to extend between and connect sidewalls 164. Front wall 150 and sidewalls 164 form corners 190 where front wall 150 meets sidewalls 164.

As discussed above, the lower rack 134 is formed from plurality of elongated members 138. Thus, bottom wall 162, front wall 150, and sidewalls 164 may be formed with wire or rod members into an open lattice structure. For example, the bottom wall 162 may be defined by a plurality of longitudinal rods 172 that are crossed with a plurality of lateral rods 170, as generally known in the art. Rods 170, 172 may be connected together by any suitable means, including welding, epoxy, clips, and so forth. A plurality of fixed tines 174 project vertically upward from bottom wall 162 and from any combination of the rods 170, 172. Accordingly, the rack assembly 130 is configured for receiving articles for cleaning.

Referring now to FIGS. 3-6, the dishwasher appliance 100 also includes a stemware holder assembly 200. In particular, FIGS. 3-6 illustrate various views of one embodiment of the stemware holder assembly 200 according to the present disclosure, wherein the stemware holder assembly 200 has a two-piece configuration. More specifically, as shown, the stemware holder assembly 200 has at least one arm member 201. For example, as shown in the illustrated embodiment, the stemware holder assembly 200 has a first arm member 202 and a second arm member 204. In particular, as shown, the first arm member 202 is mounted to one of the side walls 164 of the lower rack 134. More specifically, as shown particularly in FIGS. 5 and 6, the first arm member 202 is mounted to the right side wall 164 of the lower rack 134. In further embodiments, it should be understood that the first arm member 202 may be mounted to any of the side walls 164 of any suitable rack assembly.

Figure 5:
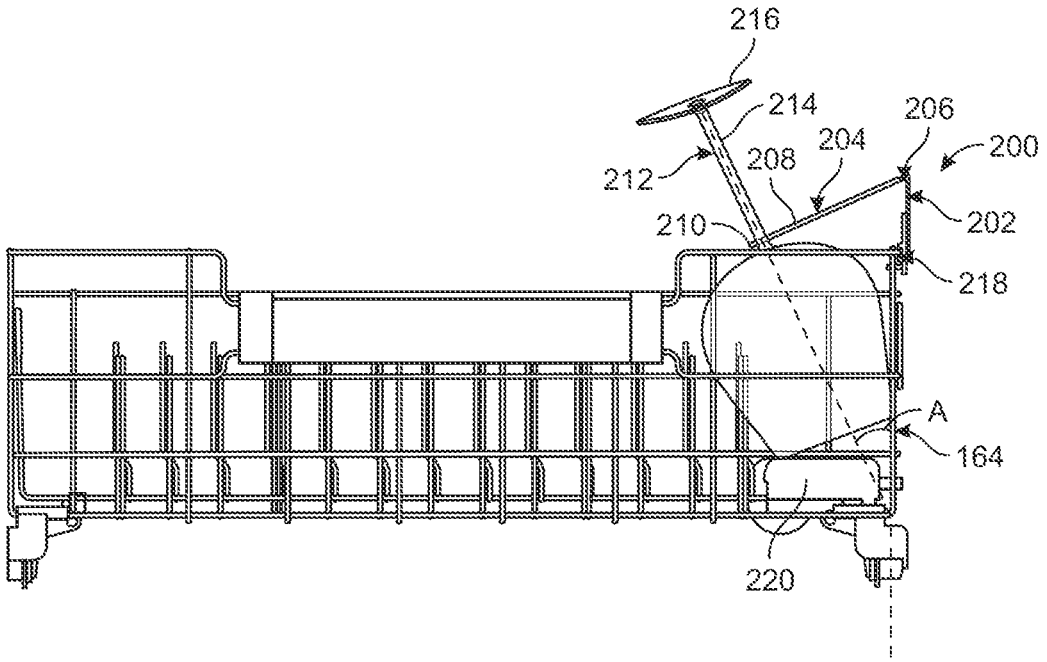
FIG. 5 illustrates a side view of a rack assembly and a stemware holder assembly according to an exemplary embodiment of the present subject matter, particularly illustrating the stemware holder assembly in an engaged position.
Figure 6:
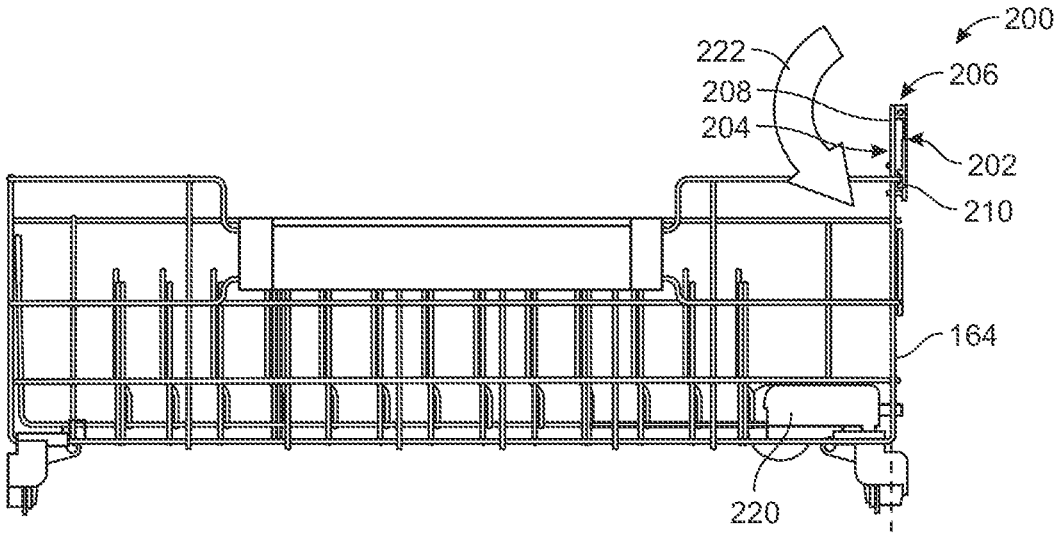
FIG. 6 illustrates a side view of a rack assembly and a stemware holder assembly according to an exemplary embodiment of the present subject matter, particularly illustrating the stemware holder assembly in a disengaged position.

Furthermore, as shown in FIGS. 5 and 6, the second arm member 204 is rotatably mounted to the first arm member 202 at a hinge point 206 such that the stemware holder assembly 200 is movable between an engaged position (FIG. 5) and a disengaged position (FIG. 6). Accordingly, in such embodiments, the first arm member 202 may be stationary, with the second arm member 204 about the first arm member 204 at the hinge point 206.

Moreover, in certain embodiments, the first and second arm members 202, 204 may be constructed of the same materials or different materials. For example, in one embodiment, the first arm member 202 may be constructed of a polymer material, whereas the second arm member 204 may be constructed of a metal material. Thus, in such embodiments, the first arm member 202 may also include an attachment location 218, e.g. that can be press-fit onto the side wall 164 of the lower rack 134. In further embodiments, the first arm member 202 can be secured to the lower rack 134 by any suitable means, including welding, epoxy, clips, and so forth. Furthermore, by constructing the second arm member 204 of metal, the second arm member 204 can be easily formed into a wire form having any suitable shape.

For example, as shown in FIGS. 3-6, the second arm member 204 may be formed to include at least one arm 208 having a hook 210 at a distal end thereof for receiving a stem 214 of a stemware 212. More specifically, as shown, the second arm member 204 defines a wire form having a plurality of arms 208 and a plurality of hooks 210, with one hook at the distal ends of each of the arms 208. Further, as shown, each of the arms 208 may extend generally parallel to each other. In addition, the hook(s) 210 described herein may have any suitable shape, such as a U-shaped hook, a C-shaped hook, and so on. Thus, when the stemware holder assembly 200 is in the engaged position, as shown in FIG. 5, the hook 208 orients the stem 214 of the stemware 212 in a direction away from the side wall 164 of the lower rack 134.

In such embodiments, as shown in FIG. 5, the direction may be selected such that fluid does not pool atop the base 216 of the stemware 212 during operation of the dishwasher appliance 100. More particularly, in certain embodiments, as shown in FIG. 5, when the hook(s) 210 of the second arm member 204 of the stemware holder assembly 200 orients the stem 214 of the stemware 212 in the direction away from the side wall 164 of the lower rack 134, the stem 212 is oriented at an angle A with respect to the side wall 164. In particular embodiments, the angle A may range from about 20 degrees to about 60 degrees.

In further embodiments, as shown in FIG. 6, the disengaged position may be defined as the second arm member 204 being rotated about the hinge point 206 (as indicated by arrow 222) towards the side wall 164 of the lower rack 134 such that the second arm member 204 is parallel with the side wall of the lower rack 134. Accordingly, the stemware holder assembly 200 does not interfere with the silverware basket 108 when not in use.

Still referring to FIGS. 3-5, the dishwasher appliance 100 may also include a silverware cleaning system 220 positioned adjacent to the lower rack 134. In such embodiments, as shown, the stemware holder assembly 200 may be positioned above the silverware cleaning system 220 or silverware blaster manifold. Thus, in such embodiments, the silverware cleaning system 220 is configured to provide an improved wash performance due to dedicated jets concentrated in this region.

Figure 7:
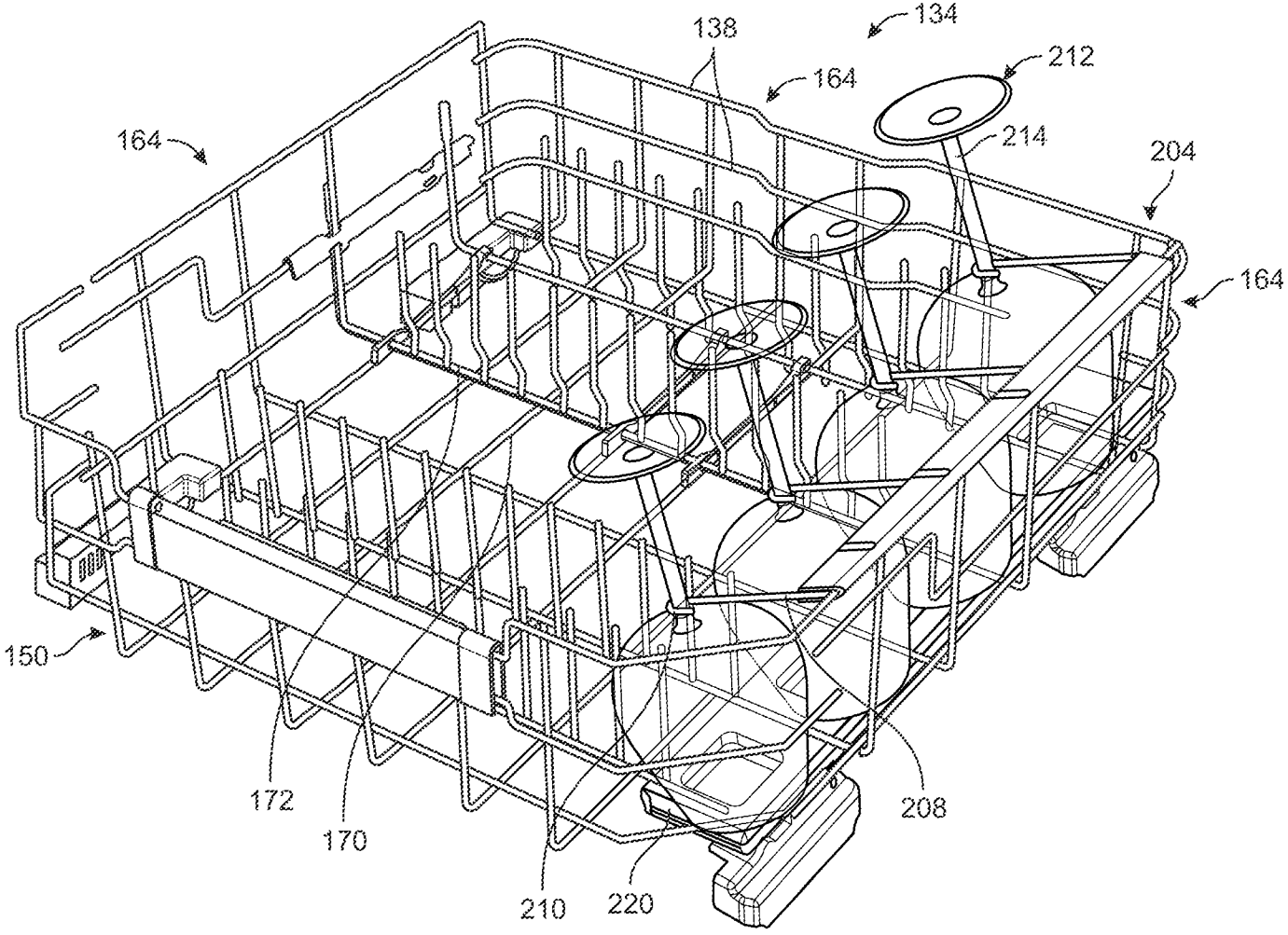
FIG. 7 illustrates a perspective view of a rack assembly and a stemware holder assembly according to another exemplary embodiment of the present subject matter.

Referring now to FIG. 7, a perspective view of another embodiment of the stemware holder assembly 200 according to the present disclosure is illustrated. In contrast to FIG. 6, however, the stemware holder assembly 200 has only a single arm member 201 (i.e. the first arm member 202 has been eliminated). In other words, the stemware holder assembly 200 has a one-piece configuration. Thus, as shown, the arm member 201 of FIG. 7 is secured directly to one of the side wall 164 of the lower rack 134. More specifically, as shown, the arm member 201 is mounted to the right side wall 164 of the lower rack 134. In further embodiments, it should be understood that the arm member 201 may be mounted to any of the side walls 164 of any suitable rack assembly. In additional embodiments, the arm member 201 may be configured similar to the second arm member 204 described herein, having, for example, a plurality of arms 208 each with a hook 210 at a distal end therefor for orienting the stem 214 of the stemware 212 in a direction away from the side wall 164 of the rack.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber;

a door mounted proximate said tub and permitting selective access to the wash chamber of the tub;

a rack assembly mounted within the wash chamber and configured for receipt of articles for cleaning, the rack assembly comprising an upper rack and a lower rack; and a stemware holder assembly comprising at least one arm member secured to a side wall of the lower rack, the at least one arm member being movable between an engaged position and a disengaged position, wherein the at least one arm member comprises at least one arm having a hook at a distal end thereof for receiving a stem of a stemware, and wherein, when the stemware holder assembly is in the engaged position, the at least one arm extends downward at an acute angle with respect to the side wall of the lower rack to position a base of the stemware further away from the sidewall than the opposite end of the stemware.

2. The dishwasher appliance of claim 1, wherein the at least one arm member comprises a first arm member and a second arm member, the first arm member being secured to the side wall of the lower rack, the second arm member rotatably mounted to the first arm member at a hinge point so as to move the stemware holder assembly between the engaged position and the disengaged position, the at least one arm being part of the second arm member.

3. The dishwasher appliance of claim 2, wherein the first arm member of the stemware holder assembly is constructed of a polymer material.

4. The dishwasher appliance of claim 2, wherein the first arm member of the stemware holder assembly comprises an attachment location that is press-fit onto the side wall of the lower rack.

5. The dishwasher appliance of claim 2, wherein the first arm member of the stemware holder assembly is stationary.

6. The dishwasher appliance of claim 2, wherein the second arm member of the stemware holder assembly is constructed of a metal material.

7. The dishwasher appliance of claim 6, wherein the metal material of the second arm member of the stemware holder assembly forms a wire form defining the hook.

8. The dishwasher appliance of claim 2, wherein the at least one arm of the second arm member is one of a plurality of arms each having a hook at a distal end thereof, and wherein each of the plurality of arms extend in a parallel direction.

9. The dishwasher appliance of claim 2, wherein the hook of the second arm member of the stemware holder assembly comprises at least one of a U-shaped hook or a C-shaped hook.

10. The dishwasher appliance of claim 1, further comprising a silverware cleaning system positioned adjacent to the lower rack, wherein the stemware holder assembly is positioned above the silverware cleaning system.

11. The dishwasher appliance of claim 1, wherein fluid does not pool atop the base of the stemware during operation of the dishwasher appliance.

12. The dishwasher appliance of claim 1, wherein the acute angle ranges from about 20 degrees to about 60 degrees.

13. The dishwasher appliance of claim 2, wherein the disengaged position comprises the second arm member being rotated about the hinge point towards the side wall of the lower rack such that the second arm member is parallel with the side wall of the lower rack.

14. A rack assembly for receipt of articles for cleaning in a dishwasher appliance, the rack assembly comprising:

at least one rack having a side wall; and a stemware holder assembly comprising at least one arm member for securing to the side wall of the at least one rack, the at least one arm member being movable between an engaged position and a disengaged position, wherein the at least one arm member comprises at least one arm having a hook at a distal end thereof for receiving a stem of a stemware, and wherein, when the stemware holder assembly is in the engaged position, the at least one arm extends downward at an acute angle with respect to the first arm member to position a base of the stemware further away from the sidewall than the opposite end of the stemware.

15. The rack assembly of claim 14, wherein the at least one arm member comprises a first arm member and a second arm member, the first arm member being secured to the side wall of the lower rack, the second arm member rotatably mounted to the first arm member at a hinge point so as to move the stemware holder assembly between the engaged position and the disengaged position, the at least one arm being part of the second arm member.

16. The rack assembly of claim 15, wherein the first arm member of the stemware holder assembly is constructed of a polymer material.

17. The rack assembly of claim 15, wherein the first arm member of the stemware holder assembly comprises an attachment location that is press-fit onto the side wall of the lower rack.

18. The rack assembly of claim 15, wherein the first arm member of the stemware holder assembly is stationary.

19. The rack assembly of claim 15, wherein the second arm member of the stemware holder assembly is constructed of a metal material formed into a wire form that defines the at least one arm and the hook.

20. The rack assembly of claim 14, wherein the acute angle ranges from about 20 degrees to about 60 degrees such that fluid does not pool atop the base of the stemware during operation of the dishwasher appliance.

* * * * *